US005473845A

United States Patent [19]

Livingston et al.

[11] Patent Number: 5,473,845

[45] Date of Patent: Dec. 12, 1995

[54] MODULAR FASTENING SYSTEM

[75] Inventors: Jerry L. Livingston, Mattoon; Garry J. McGovern, Barrington, both of Ill.

[73] Assignee: Justrite Manufacturing Company, Inc.

[21] Appl. No.: 230,092

[22] Filed: Apr. 20, 1994

[51] Int. Cl.[6] ..... E04H 14/00

[52] U.S. Cl. ..... 52/79.9; 312/111; 211/194; 403/353

[58] Field of Search ..... 52/79.1, 79.9, 52/79.13, 79.7, 79.8, 720, 721, 169.6; 403/353, 375; 211/188, 194; 312/111, 107

[56] References Cited

U.S. PATENT DOCUMENTS

| | | | |
|---|---|---|---|
| 2,203,716 | 6/1940 | Bergman | 312/107 |
| 2,614,016 | 10/1952 | Regenhardt | 312/111 |
| 2,675,287 | 4/1954 | Sitler | 312/111 |
| 3,465,895 | 9/1969 | Miller | 403/353 X |
| 3,703,058 | 11/1972 | Klett | 52/579 X |
| 4,096,816 | 6/1978 | Patterson, III et al. | 403/353 X |

FOREIGN PATENT DOCUMENTS

| | | | |
|---|---|---|---|
| 87546 | 6/1982 | Japan | 403/353 |
| 472199 | 9/1937 | United Kingdom | 52/579 |

*Primary Examiner*—Carl D. Friedman
*Assistant Examiner*—Yvonne Horton-Richardson
*Attorney, Agent, or Firm*—Irwin C. Alter

[57] ABSTRACT

This invention relates to an apparatus and process for joining an add-on module to a base module to form a modular material storage building by selective positioning of the add-on module with respect to the base module. The invention includes protruding locking members having a locked position, a plurality of locking apertures having a locked position and a roof connector assembly where the protruding locking member is affixed to a vertical leveling bar for stabilizing and locking the modules together which is plumbed with and affixed to the base module near a side wall edge, the locking apertures are in communication with a vertical leveling bar plumbed with and affixed to the add-on module near a side wall edge to orient the locking apertures for locking with the protruding locking members, the locked position of the locking apertures is adapted to engage and lock with the locked position of the protruding locking member of the base module, and where the roof connector assembly has a female channel member attached to a roof edge of the base module and a male channel member attached to the add-on module such that the male channel member seats within the female channel member for aligning and joining the modules in conjunction with the engagement and locking of the apertures with the protruding locking members.

21 Claims, 2 Drawing Sheets

FIG. 5
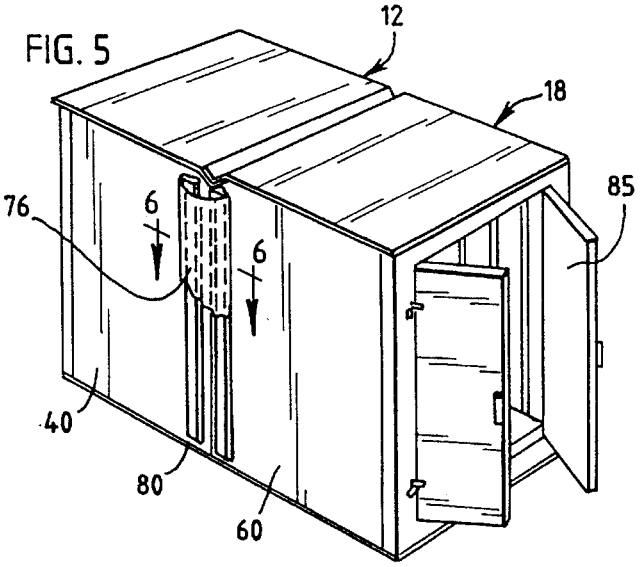
FIG.6
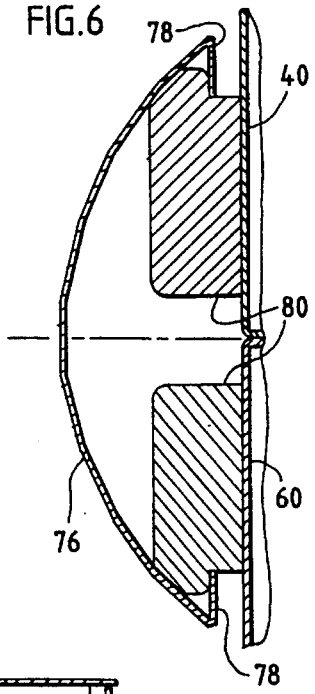
FIG. 7
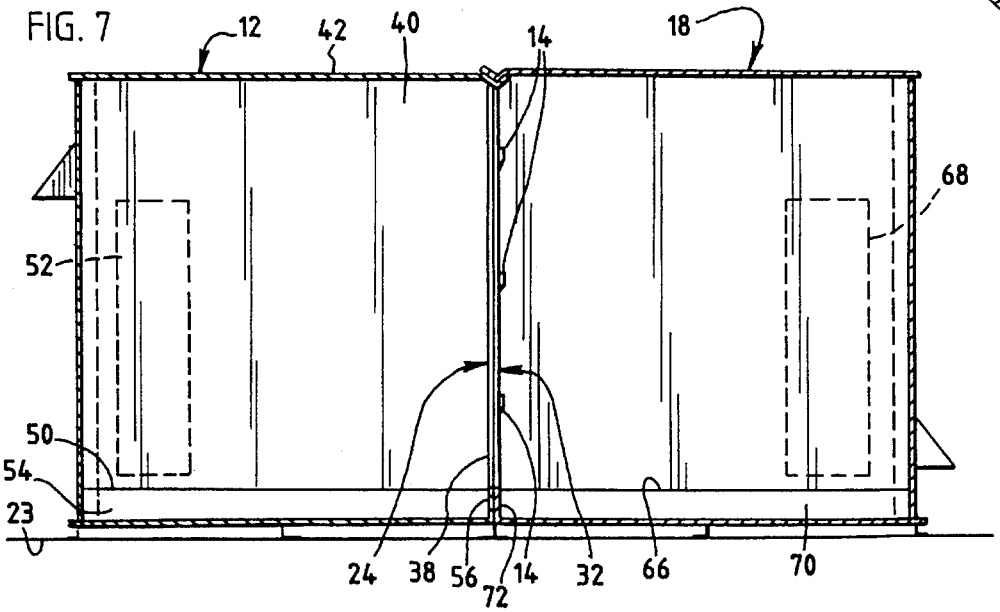
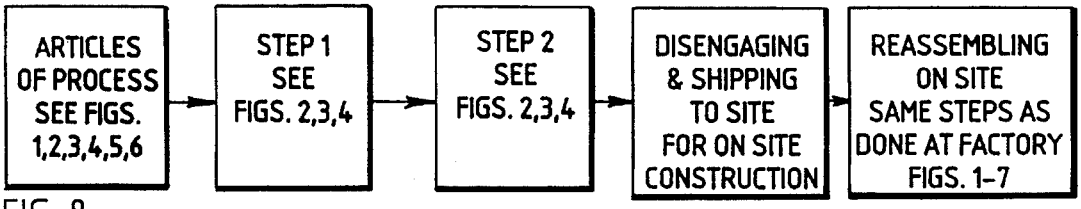
FIG. 8
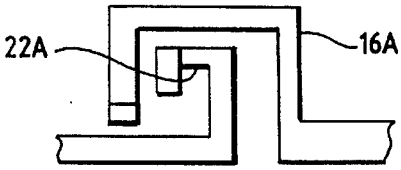
FIG. 9

MODULAR FASTENING SYSTEM

BACKGROUND OF INVENTION

This invention relates generally to an improved apparatus and process for joining together modules of a modular material storage building. The invention incorporates a base module and at least one add-on module which may be formed as independent storage units or have open faces and which are combined to form one modular material storage building. During manufacture, the base module is provided with a plurality of hook-like protruding locking members and an elongated female channel along a roof edge. The protruding locking members and the female channel will mate with corresponding locking apertures and a male channel on the add-on module. To construct the modular material storage building, the base module is positioned on any level surface or foundation provided, the add-on module is raised and maneuvered adjacent to the base module, and the locking apertures are engaged with the protruding locking members and then lowered into a locked position. The joined base and add-on modules may be repositioned as a unit by lifting the base module itself.

At the present the systems known are those which are typically, separate modules of a modular material storage building that may be joined by welding the two modules together. This type of construction does not lend itself to on site construction or factory assembly of buildings larger than permitted for normal truck shipment.

Another typical fastening method is to use screws, bolts, nails or the like. These types of fasteners are invasive and can adversely affect the structural integrity of the modules to the extent that leaks can occur. Further, special tools are necessary for on site construction.

Neither welding or the use of fasteners discloses, teaches, or suggests the use of a non-invasive self-guiding locking member and aperture assembly which does not require specialized equipment, tools or training as in the present invention. Further, neither welding or the use of fasteners discloses a method of joining the modules where ready disassembly of the module material storage building may be achieved by raising one module with respect to the other and maneuvering the module away from the base module.

SUMMARY AND OBJECTS OF THE INVENTION

Accordingly, it is an object of the present invention to provide an apparatus and process for joining modules of a modular material storage building which includes cooperating protruding locking members and locking apertures for stabilizing and locking an add-on module with a base module without the necessity of special equipment or tools by selective positioning of the add-on module with respect to the base module. The protruding locking members have a lock position and are affixed to a vertical leveling bar plumbed with and attached to the base module near a side wall edge. The locking apertures are formed or welded in a vertical leveling bar for engagement and locking with the protruding locking members of the base module where the vertical leveling bar is plumbed with and affixed to the add-on module near a side wall edge to orient the locking apertures for locking with the protruding locking member. The locking apertures include a lock position adapted to engage the protruding locking members of the base module where the add-on module is selectively displaced upward adjacent to the base module, and further adapted to lock with the lock position of the protruding locking members with the add-on module selectively aligned with the base module on a support surface.

A roof connector assembly is provided preferably having a female V-channel member attached to a roof edge of the base module and a male V-channel member attached to the add-on module. The male V-channel member is adapted to seat within the female V-channel member for aligning and joining the add-on module with the base module in conjunction with the engagement and locking of the locking apertures with the protruding locking members.

DETAILED DESCRIPTION OF THE DRAWINGS

In order to satisfy the objectives of the invention described herein, an improved fastening system and process is provided for joining two modules to form a modular storage building as illustrated by the accompanying drawings wherein:

FIG. 5 is a pictorial view of the modules joined together illustrating snap strips on the side of the modules and a batten engaging the snap strips;

FIG. 6 is a side elevational view of the batten and snap strips as viewed from the direction of reference arrows 6—6 of FIG. 5;

FIG. 7 is a side elevational view, in partial section of a floor, a sump and a sump wall of each module into which the flow of spilled materials into the sumps may be directed;

FIG. 8 is a schematic diagram of the process for removably joining the add-on module to the base module to form a modular material storage building; and FIG. 9 is an alternate embodiment showing two inverted L shaped channels, a female inverted L shaped channel **16*a* and a male inverted L shaped channel 22*a***.

DESCRIPTION OF THE PREFERRED EMBODIMENT

Figure 1:
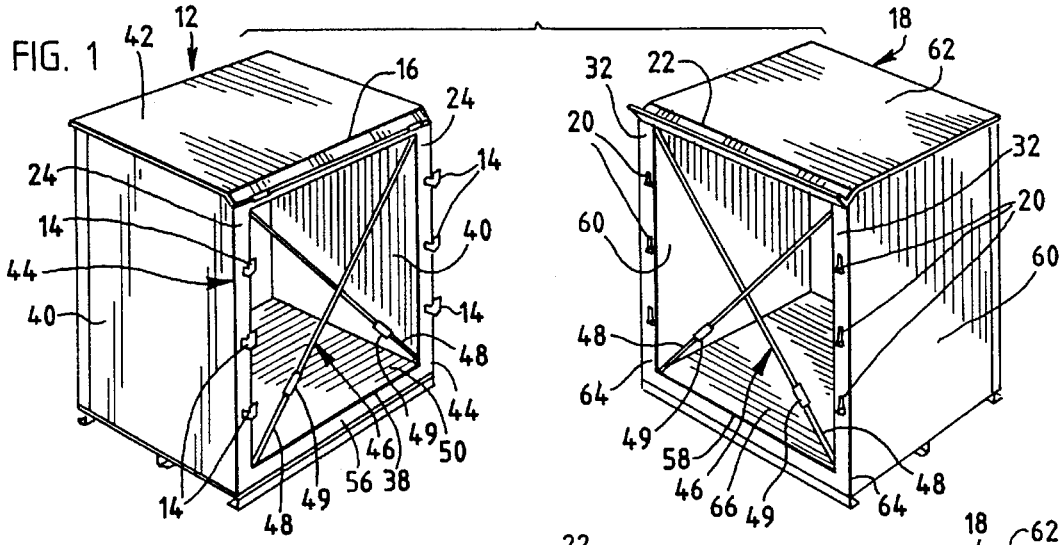
FIG. 1 is a pictorial view of an open-faced base module illustrating a turnbuckle assembly, a plurality of protruding locking members and a female V-channel and an open-faced add-on module illustrating a turnbuckle assembly, a plurality of locking apertures and a male V-channel.

Referring to FIG. 1, the modular fastening assembly of the invention generally is designated by the reference numeral 10. It includes a base module 12 having protruding locking members 14 and a female V-channel 16 and an add-on module 18 having locking apertures 20 and a male V-channel 22.

Figure 2:
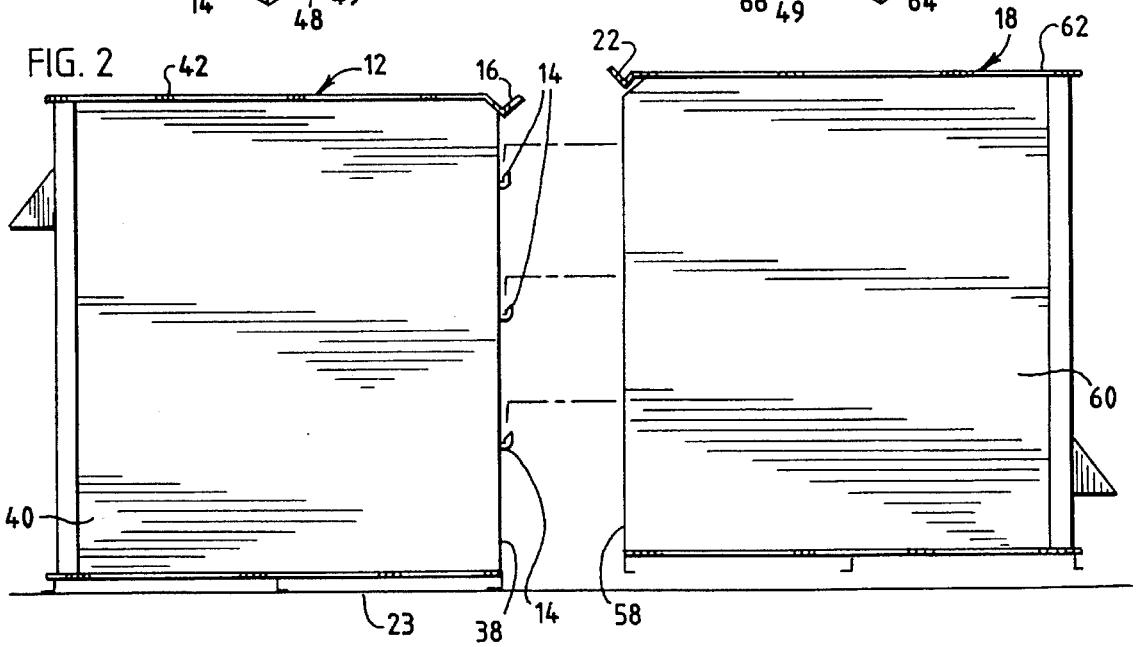
FIG. 2 is a side elevational view of the base module and the add-on module illustrating the add-on module in a raised position in preparation for engagement of the locking apertures with the protruding locking members.

Briefly, in operation, the base module 12 is positioned on a support surface 23, such as a concrete pad or the like as illustrated in FIG. 2. To join the add-on module 18 with the base module 12, the add-on module 18 is raised a predetermined distance by a forklift, crane or the like (not illustrated) in order to align the locking apertures 20 with the protruding locking members 14. Add-on module 18 is maneuvered adjacent to the base module 12 in order to engage the locking apertures 20 of the add-on module 18 with the protruding locking members 14 of the base module 12. To lock the locking apertures 20 and the protruding locking members 14, one with the other, and prevent separation of the base module 12 and the add-on module 18, the add-on module 18 is lowered to the support surface 23. To provide an additional locking effect and prevent the seepage of moisture through the top joint between the modules 12 and 18, the male V-channel 22 of the add-on module 18 seats within the female V-channel 16 of the base module 12. Due to the locking effect induced by the cooperation of the locking apertures 20 with the protruding locking members 14 and the cooperation of the male V-channel 22 with the female V-channel 16, the joined base module 12 and add-on module 18 may be repositioned as a unit by lifting the base module 12 which raises the add-on module 18.

As seen from FIG. 9, a reverse L shaped male elongated channel 22*a* can align with a reverse elongated L shaped female channel 16*a* and can be substituted for the V shaped channels to provide the additional locking effect and improve waterproofing against water seepage without caulking of the top joint.

Figure 3:
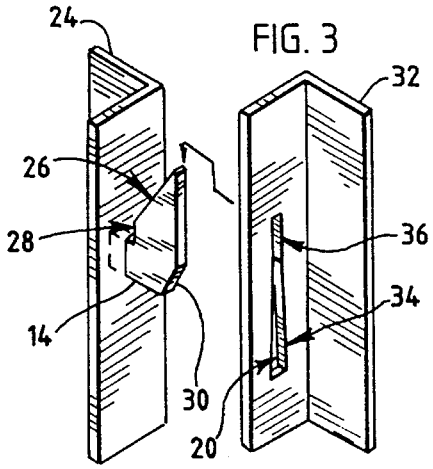
FIG. 3 is a pictorial view illustrating the protruding locking member mounted on a vertical locking bar and the locking aperture provided on a vertical locking bar where the locking aperture is aligned with the protruding locking member prior to engagement.

As FIG. 3 illustrates, the protruding locking member 14 is affixed to a vertical locking bar 24. The protruding locking member 14 may be constructed of plate steel, preferably 12 gauge. The vertical locking bar 24 preferably is constructed of steel angle iron with the protruding locking member 14 welded thereto.

To facilitate engagement of the locking aperture 20 with the protruding locking member 14, the protruding locking member 14 is provided with a slide portion 26 tapered inwardly, upwardly. To prevent displacement of the add-on module 18 with respect to the base module 12 when joined, the protruding locking member 14 is provided with a locking portion 28 which is adapted to receive the locking aperture 20 in tight fitting engagement. The protruding locking member 14 may be provided with a notched portion 30 to reduce the frontal area and assist in the insertion of the protruding locking member 14 into the locking aperture 20.

The locking aperture 20 is provided in a vertical locking bar 32, preferably by punching. To facilitate the engagement of the protruding locking member 14 with the locking aperture 20, the locking aperture 20 may be provided with a guide portion 34 formed wider than the protruding locking member 14. Preferably the guide portion 34 tapers inwardly, upwardly into a locking portion 36.

Figure 4:
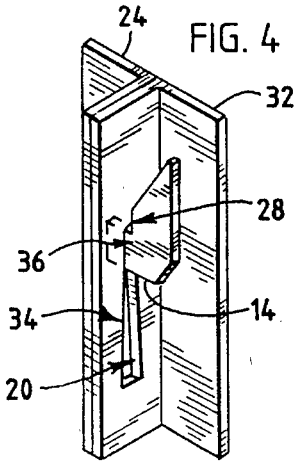
FIG. 4 is a pictorial view illustrating the locking aperture in a locked position after engagement with the protruding locking member.

The locking portion 36 of the locking aperture 20 is adapted to mate with the corresponding locking portion 28 of the protruding locking member 14 to provide the desired tight fit and the resulting locking effect. FIG. 4 illustrates the locking portion 36 of the locking aperture 20 in locking engagement with the locking portion 28 of the protruding locking member 14.

Typically, the base module 12 is a rectangular structure having an open face 38 as FIG. 1 illustrates. Generally, the sidewalls 40 and roof 42 of the base module 12 are constructed of sheet steel, although the specific construction of the base module 12 could vary depending upon the intended use or the particular material being stored therein. To accommodate different storage capacities, the base module 12 may be provided in various incremental lengths and widths.

To accommodate variations in the dimensional tolerances of the base module 12 during construction, each vertical leveling bar 24 with the attached protruding locking members 14 is selectively positioned on an inside open edge 44 of each side wall 40 and plumbed with respect to a selected vertical reference or perpendicular to a selected horizontal reference. After plumbing, each vertical leveling bar 24 is affixed to each inside open edge 44 preferably by welding. To insure a tight joint when joining the base module 12 and the add-on module 18, each vertical leveling bar 24 also is mounted flush with respect to the other vertical leveling bar 24 mounted to the other sidewall 40.

To provide additional strength to the base module 12 near the open face 38 and to bring the open face 38 into a perfectly square configuration for proper joining of the modules 12 and 18, a turnbuckle assembly 46 or other such adjustable squaring assembly is provided near the open face 38. Cross members 48 are provided which extend diagonally from corner to corner. To adjust the cross members 48 and square the base module 12, the cross members 48 can be provided with typical turnbuckle screws 49 which are known in the art. To permit ready removal of the cross members 48 after joining of the modules 12 and 18, the cross members 48 can be provided at their ends with quick hook fasteners (not illustrated).

To provide an additional locking effect and assist in the alignment of the add-on module 18 with the base module 12, the female V-channel 16 is formed with the roof 42 near the open face 38 preferably during construction of the base module 12 by a press brake (not illustrated) or other similar equipment. While configured as a V-channel, the female V-channel 16 may be provided with an alternative cross sectional configuration so long as the male V-channel 22 matches the cross sectional configuration to provide the desired locking effect and assist in alignment.

The base module 12 preferably is provided with a raised floor 50 for supporting material storage containers 52 especially hazardous materials and waste in 55 gallon steel drums which overlies a self-contained sump 54 located below the floor 50 as FIG. 7 illustrates. The sump 54 is leak-proof and serves to segregate any spilled material therein (especially hazardous liquid chemicals) to prevent contamination of the environment. The floor 50 may be constructed of plywood having apertures for drainage, fiberglass grating, steel grating or other suitable material so long as it provides the desired strength and permits drainage of spilled materials into the sump 54. The sump 54 may be constructed of steel or other suitable material and is provided with a sump wall 56 located across the entire open face 38 so that the base module and add-on module have separate, leak tight containment sumps.

The add-on module 18 is typically a rectangular structure having an open face 58, sidewalls 60 and a roof 62 as FIG. 1 illustrates. To brace and permit adjustment of the configuration of the add-on module 18, the turnbuckle assembly 46, as installed in the base module 12, is also installed in the add-on module 18. Diagonal cross members 48 can similarly be provided from corner to corner and attached to quick fastening hooks (not illustrated).

To insure proper alignment of the locking apertures 20 of the add-on module 18 with the protruding locking members 14 of the base module 12, the vertical leveling bars 32 are plumbed with respect to the selected vertical reference in alignment with the corresponding vertical leveling bars 24 of the base module 12. Each vertical leveling bar 32 is attached to the add-on module 18 in this aligned position preferably by welding the vertical leveling bars 32 to each sidewall 60 of the add-on module 18. To insure the proper alignment of the base module 12 with the add-on module 18, each vertical leveling bar 32 is affixed to inside open edges 64 of the sidewall 60 flush one with the other. The aligned position is such that the locking apertures 20 engage the protruding locking member 14 as illustrated in FIG. 4 when both the base module 12 and the add-on module 18 rest on the support surface 23 (not illustrated in FIG. 4).

To provide an additional locking force and assist in aligning the modules 12 and 18, the male V-channel 22 is formed with the roof 62 of the add-on module 18 near the open face 58. The male V-channel 22 is adapted to seat within the female V-channel 16 when the add-on module 18 is joined with the base module 12. The male V-channel 22 may be provided with an alternate cross-sectional configuration so long as the male V-channel 22 mates with the female V-channel 16 to satisfy the desired objects.

As FIG. 7 illustrates, the add-on module 18 may be provided with a raised floor 66 for supporting material storage containers 68 which overlies a sump 70. The sump 70 has a sump wall 72 in order to segregate any spilled material (not illustrated) which abuts against the sump wall 56 when the add-on module 18 and base module 12 are joined together on the support surface 23.

To prevent seepage of spilled material between the sump wall 56 and the sump wall 72 after joining, not shown on FIG. 7, the sump walls 56, 72 are sealed together. Preferably the seal is provided by a drip cap (not illustrated) or other methods known in the art which deflect spills into the sumps 54, 70. The method of sealing should avoid penetrating the sump walls 56, 72 and destroying the leak-proof integrity of the sumps 54, 70.

To weatherize and provide an aesthetically pleasing covering to the joints between the sidewalls 40 of the base module 12 and the adjacent sidewalls 60 of the add-on module 18, battens 76 of steel or suitable other materials (e.g. plastic) may be provided as illustrated in FIG. 5. The batten 76 is illustrated in a mounted position in FIG. 5 and preferably has a cross-sectional configuration with flanges 78 bent inwardly as illustrated in FIG. 6. The cross-sectional configuration illustrated in FIG. 6 provides a spring-like quality. The batten 76 has a length equivalent to the height of the sidewalls 40, 60.

To mount the batten 76 to the joint between the sidewalls 40, 60, a pair of snap strips 80 are mounted one on each side wall 40 and 60 as FIG. 5 illustrates. Each snap strip 80 is adapted to receive the flanges 78 of the batten 76 as FIG. 6 illustrates. Preferably the batten 76 is constructed of a spring-like material which permits the batten 76 to be flattened and expand width wise to permit the flanges 78 to seat within the snap strips 80 and to be released to permit the batten 76 to return to an unflattened, seated configuration.

In operation, the base module 12 is positioned on the support surface 23 as FIG. 5 illustrates. FIG. 1–7 illustrate the apparatus of the invention and FIG. 8 generally illustrates the steps of the process. The protruding locking members 14 are mounted to the base module 12 by plumbing and attaching one of the vertical leveling bars 24 to each side wall 40. The female V-channel 16 also has been formed with the roof 42 of the base module 12.

The unattached vertical leveling bars 32 having locking apertures 20 which will be mounted on the add-on module 18 are then plumbed and aligned with the protruding locking members 14 on the base module 12. Add-on module 18 is then positioned adjacent to the base module 12. Once the modules 12 and 18 are properly aligned, vertical leveling bars 32 are welded to the side walls 60 of the add-on module 18. The male V-channel 22 has been formed with the roof 42 and aligned with the female V-channel 16.

To disengage the locking apertures 20 from the protruding locking members 14, the add-on module 18 is lifted by a forklift, crane or other such device. The modules 12 and 18 are separated and shipped to a particular operating site.

Reattaching the add-on module 18 to the base module 12 is accomplished by positioning the base module 12 in a selected position. In the event that shifting of the configurations of the base module 12 and the add-on module 18 occurs during transit, each turnbuckle assembly 46 may be adjusted accordingly to square the modules 12 and 18 and insure alignment.

The add-on module 18 is lifted by a forklift, crane or other such device. Add-on module 18 is maneuvered adjacent to the base module 12 to engage the locking apertures 20 with their corresponding protruding locking members 14. The guide portion 34 of the locking apertures 20 permits the protruding locking members 14 to be readily aligned and inserted together.

The tapered configurations of the slide portion 26 of each protruding locking member 14 as well as the guide portion 34 of each locking aperture 20 serves to draw the two modules 12 and 18 tightly together as the add-on portion 18 is lowered into position. The add-on module 18 is further guided into position by the mating of the male V-channel 22 with the female V-channel 16.

The add-on module 18 is locked into position adjacent to the base module 12 by the seating of the locking portion 36 of each locking aperture 20 and the locking portion 28 of each protruding locking member 14 as well as the seating of the male V-channel 22 within the female V-channel 16. This locking position of the locking apertures 20 and the protruding locking members 14 is illustrated in FIG. 4. Once joined, the add-on module 18 moves in conjunction with the base module 12 as a single building unit.

Once joined, the sump walls 56, 72 abut one against the other to separate the sumps 54, 70 as FIG. 7 illustrates. To prevent seepage of any spilled material into the joint between the sump walls 56, 72, the joint 74 between the sump walls 56, 72 is sealed.

To weatherproof the joints between the side walls 40, 60 of their respective modules 12, 18, the batten 76 is positioned over the snap strips 80 affixed to the modules 12, 18 as FIGS. 5 and 6 illustrate and then flattened by palm pressure or the like. Releasing the pressure on the batten 76 permits the batten 76 to return to its undeformed shape which permits the flanges 78 to slide and engage the snap strips 80 for a weather-tight seal. Weather caulking typically known to one skilled in the art may also be applied to the joints to provide additional weatherproofing.

Alternatively, an additional open face (not illustrated) may be provided on the side of the add-on module 18 opposite the open face 58. The additional open face 84 may be provided with vertical leveling bars 32 having protruding locking members 14. The additional open face (not illustrated) essentially is constructed like the open face 38 of the base module 12. An add-on module 18 (not illustrated) may be attached thereto to extend the overall size of the modular building.

FIG. 5 illustrates a door 85 which may be attached to add-on member 18 but alternatively may be attached to base member 12. The location of the door can vary depending upon the intended use.

It may thus be seen that the objects of the present invention set forth herein as well as those made apparent from the foregoing description, are efficiently obtained. While preferred embodiments of the invention have been set forth for purposes of disclosure, modification of disclosed embodiments of the invention as well as other embodiments thereof may occur to those skilled in the art. Accordingly, the appended claims are intended to cover all embodiments which do not depart from the spirit and scope of the invention.

What we claim is:

1. A modular fastening apparatus for removably joining at least a face of a first module and an opposing face of an adjacent second module to form a modular material storage building comprising:

protruding locking members affixed to a first vertical leveling member for stabilizing and locking said first module with said second module by selective positioning of said second module with respect to said first module, said protruding locking members having a locked position, said first vertical leveling member being plumbed with respect to said first module and affixed to said face of said first module to orient said protruding locking means for locking with said second module; and apertures positioned adjacent to a second vertical leveling member for engagement and locking with said protruding locking members of said first module, said second vertical leveling member being plumbed with respect to said second module and affixed to a face of said second module to orient said apertures for locking with said protruding locking members, said apertures including a locked position adapted to engage with said protruding locking members of said first module with said second module being selectively displaced adjacent to said first module and adapted to lock with said locked position of said protruding locking members with said second module selectively aligned with respect to said first module, said faces of the first and second modules each defining an opening for registry with the other module opening when the modules are joined, said openings comprising most of the area of said faces.

2. The apparatus as defined in claim 1, wherein said second module is formed as an intermediate module which includes a second face having protruding locking members attached thereto for stabilizing and locking said second face of said intermediate module with an adjacent face of a third module or any number where desired by selective positioning of said third module with respect to said intermediate module, and said adjacent face of said third module being provided with apertures mounted thereto for engaging and locking with said protruding locking members of said intermediate module.

3. The apparatus as defined in claim 1, which includes a roof connector assembly having an open female channel member attached to a roof edge of one of said modules and a male channel member attached to an adjacent roof edge of the other of said modules, said male channel member adapted to sealingly seat within said female channel member for aligning and joining said second module with said first module in conjunction with said engagement and locking of said apertures with said protruding locking members.

4. The apparatus as defined in claim 3, wherein said protruding locking members include at least one protruding locking member having a tapered slide portion and a locked portion and said apertures comprise at least one aperture having a tapered guide portion adapted to engage a slide portion of said protruding locking member and having a locked portion adapted to lock with said locked portion of said protruding locking member.

5. The apparatus as defined in claim 1, wherein said protruding locking members include at least one protruding locking member having a tapered slide portion and a locked portion, and said apertures comprise at least one aperture having a tapered guide portion adapted to engage a slide portion of said protruding locking member and having a locked portion adapted to lock with said locked portion of said protruding locking member.

6. The modular fastening apparatus of claim 1 in which said faces of each of the first and second modules are rectangular, and carry diagonally positioned, adjustable-length cross members connected at their ends to corners of said face to facilitate the fine adjustment of the peripheral shape of said faces to facilitate proper joining of said modules.

7. The modular fastening apparatus of claim 6 in which the adjustable-length, diagonal cross member of each face comprises a pair of turnbuckle rods arranged in transverse relation to each other and connected to opposed diagonal corners of said rectangular face.

8. The apparatus of claims 7 in which said joined modules define a load carrying floor and a sump chamber positioned below said floor for receiving spilled liquids.

9. The apparatus of claim 1 in which said joined modules define a load carrying floor and a sump chamber positioned below said floor for receiving spilled

10. A process for stabilizing and removably joining at least a first module to a second module to form a modular material storage building at a storage site, said first module having a protruding locking member affixed to a first vertical leveling bar and said second module having a locking aperture in communication with a second vertical leveling bar, said process comprising the steps of:

(a) plumbing said first leveling bar with respect to said first module and said second leveling bar with respect to said second module to provide said protruding locking member in aligned orientation with respect to said locking aperture;

(b) initially removably engaging said protruding locking member of said first module and said locking aperture of said second module to ensure locking engagement of said locking aperture with said protruding locking member;

(c) disengaging said first and second modules including shipping said first and second modules to site for on site construction;

(d) reassembling said first and second modules on site including selectively displacing said second module a predetermined distance with respect to said first module, engaging said locking aperture of said second module with said protruding locking member of said first module, and selectively aligning said second module and said first module to lock said aperture with said protruding locking member.

11. The process of claim 8 in which said first and second modules are removably joined at respective faces to place an opening respectively formed in each of said faces in registry with the other opening, said openings comprising most of the area of said faces.

12. The process of claim 11 in which length-adjustable cross members extend diagonally across each of said openings, and further including the step of adjusting the length of said cross members to adjust the peripheral positioning of each of said faces as said first and second modules are brought together, to facilitate engagement of said protruding locking member and said locking aperture.

13. The process of claim 12 in which said length-adjustable cross members are removed after said reassembling of said first and second modules.

14. A process for joining faces of at least a first module to a second module to form a modular building, one of said modules having protruding locking members extending from a face of said one module, the other module defining a plurality of locking apertures positioned on a face of said other module, the respective module faces each defining an opening capable of registry with the opening of the other module face when the modules are joined, each of said module faces carrying at least one adjustable-length cross member attached at respective ends to its face; which method comprises: respectively adjusting the length of said length-adjustable diagonal cross members of each face to bring the respective faces by cross member tension into positions that permit the locking members to enter and lock with the locking apertures, while bringing the respective faces of said modules into abutting relationship.

15. The process of claim 14 including the subsequent step of removing said adjustable-length cross members, whereby the interior of said modules are open to each other through said abutting openings.

16. The process of claim 15 in which said module faces are rectangular.

17. The process of claim 16 in which the adjustable-length cross member of each face comprises a pair of turnbuckle rods arranged in transverse relation to each other and connected diagonally to opposed corners of said rectangular face.

18. A modular building which comprises first and second building modules each having a face for joining together so that the modules form a single building, each of said faces defining an opening which is in registry with the opening of the other face when the modules are joined, one of said faces comprising a locking member including a male hook member having an inclined surface and a notched portion, and the other of said faces comprising a female member having an aperture with an inclined guide portion that receives and guides said male hook member and secures said male hook member when said notched portion frictionally engages said aperture when said modules are in face-to face relation.

19. The modular building of claim 18 in which said opening in the faces comprise most of the area of said faces.

20. The modular building of claim 18 in which length-adjustable cross members extend diagonally across each of said faces and are secured at cross member ends on or near said faces, to facilitate the fine adjustment of the peripheral shape of said faces to facilitate proper joining of said modules.

21. The building of claim 18 which includes a roof connector assembly having an open female channel member attached to a roof edge of one of said modules and a male channel member attached to an adjacent roof edge of the other of said modules, said male channel member adapted to sealingly seat within said female channel member for further aligning, sealing, and joining of said modules together.

* * * * *

UNITED STATES PATENT AND TRADEMARK OFFICE

CERTIFICATE OF CORRECTION

PATENT NO. : 5,473,845

DATED : December 12, 1995

INVENTOR(S) : Jerry L. Livingston and
Garry J. McGovern

It is certified that error appears in the above-identified patent and that said Letters Patent is hereby corrected as shown below:

Column 8, line 27: After "spilled", add --liquids--.

Signed and Sealed this

Twenty-sixth Day of March, 1996

Bruce Lehman

*Attest:*

BRUCE LEHMAN

*Attesting Officer*

*Commissioner of Patents and Trademarks*